73-659 SR
8/10/82 XR 4,344,140

United States Patent [19]
Leung

[11] 4,344,140
[45] Aug. 10, 1982

[54] CLOSED LOOP ENGINE ROUGHNESS CONTROL

[75] Inventor: Chun-Keung Leung, Farmington, Mich.

[73] Assignee: The Bendix Corporation, Southfield, Mich.

[21] Appl. No.: 187,394

[22] Filed: Sep. 15, 1980

[51] Int. Cl.³ ..... F02D 5/02; F02M 51/00; F02B 3/08

[52] U.S. Cl. ..... 364/431.08; 123/435; 123/487; 123/478; 73/659; 364/431.03; 364/508

[58] Field of Search ..... 364/431.04, 431.05, 364/431.06, 431.07, 431.08; 73/650, 659, 462, 415, 416; 123/425, 435, 436, 478, 486, 488, 492, 493

[56] References Cited

U.S. PATENT DOCUMENTS

| | | | |
|---|---|---|---|
| 3,733,892 | 5/1973 | Rennick | 73/659 |
| 3,789,816 | 2/1974 | Taplin et al. | 123/436 |
| 3,800,599 | 4/1974 | Goran | 73/116 |
| 3,872,846 | 3/1975 | Taplin et al. | 123/568 |
| 3,885,420 | 5/1975 | Wolfinger | 73/650 |
| 4,015,566 | 4/1977 | Wahl | 123/415 |
| 4,018,087 | 4/1977 | Wenz | 73/462 |
| 4,044,234 | 8/1977 | Frobenius et al. | 364/431.08 |
| 4,044,235 | 8/1977 | Frobenius | 364/431.08 |
| 4,044,236 | 8/1977 | Bianchi et al. | 364/431.06 |
| 4,064,846 | 12/1977 | Latch et al. | 123/483 X |
| 4,092,955 | 6/1978 | Reddy | 73/650 |
| 4,104,990 | 8/1978 | Frobenius | 123/436 |
| 4,112,879 | 9/1978 | Assenheimer et al. | 123/478 |
| 4,140,083 | 2/1979 | Frobenius | 364/431.08 X |
| 4,161,162 | 7/1979 | Latsch et al. | 123/435 |
| 4,172,433 | 10/1979 | Bianchi et al. | 123/435 |

FOREIGN PATENT DOCUMENTS

| | | |
|---|---|---|
| 1512213 | 5/1978 | United Kingdom . |
| 1520427 | 8/1978 | United Kingdom . |

OTHER PUBLICATIONS

Randall et al: Closed Loop Control of Internal Combustion Engine Efficiency and Exhaust Emissions, Stanford University Research Report Dot-0S-30111 May 1976 pp. 29-34.

*Primary Examiner*—Felix D. Gruber
*Attorney, Agent, or Firm*—Russel C. Wells; Gaylord P. Haas, Jr.

[57] ABSTRACT

A closed loop engine roughness fuel control for an internal combustion engine operative to maintain the operation of the engine at a predetermined roughness level is disclosed herein. The control measures two rotational intervals within each torque impulse imparted to the engine's crankshaft by the combustion process and generates a speed normalized engine roughness signal indicative of the engine's actual roughness. The engine roughness signal is multiplied by the engine speed and summed with a reference signal to generate a bias signal operative to modify the quantity of fuel being delivered to the engine maintaining the operation of the engine at a predetermined roughness level. A signal indicative of the first derivative of the engine speed is also summed with the reference and roughness signal to compensate for false roughness signals generated during transient modes of operation. A start enrichment circuit, activated when the engine speed is below a predetermined speed, causes the roughness control to output a fixed bias signal indicative of the engine having a roughness level greater than the desired roughness level. The fixed bias signal causes the fuel control computer to increase the quantity of fuel to the engine to enhance starting of the engine and until the engine reaches the predetermined speed.

13 Claims, 4 Drawing Figures

CLOSED LOOP ENGINE ROUGHNESS CONTROL

CROSS REFERENCE TO AND INCORPORATION OF RELATED CO-PENDING APPLICATIONS

This application is one of six applications originally filed on May 8, 1978 all commonly assigned and having substantially the same specification and drawings, the six applications being identified below:

| Parent Serial Number | Continuation Serial Number | Filing Date | Title |
|---|---|---|---|
| 904,131 | 187,400 | 9/15/80 | Closed Loop Timing and Fuel Distribution Control |
| 904,132 | 188,803 | 9/19/80 | Digital Roughness Sensor |
| 904,137 | 187,392 | 9/15/80 | Timing Optimization Control |
| 904,138 | 187,393 | 9/15/80 | Intergrated Closed Loop Engine Control |
| 904,139 | 187,394 | 9/15/80 | Closed Loop Engine Roughness Control |

Application Ser. No. 904,129, now U.S. Pat. No. 4,197,767, which issued Apr. 15, 1980 and has been printed in its entirety, including FIGS. 1–56, and the specification of that patent is specifically incorporated herein by reference.

BACKGROUND OF THE INVENTION

1. Field of the Invention

The invention is related to electronic fuel controls for internal combustion engines, and in particular, a closed loop engine roughness fuel control closed about the instantaneous rotational velocity of the engine's crankshaft.

2. Prior Art

Electronic ignition and fuel control systems for internal combustion engines are finding acceptance in the automotive and allied industries as rigid efficiency and pollution standards are imposed by the government. The first generation of these electronic controls were open loop systems which became progressively complex as the standards were raised. The number of variables needed to be detected as well as auxiliary circuits for providing corrections for these variables increased with each raising of the standards. From the conception of electronic control systems for internal combustion engines, it has been known that if the control systems could be closed about the engine, simpler control systems could be developed. This would reduce the number of variables needed to be detected, reduce the complexity of the control systems, and at the same time improve the overall efficiency. The problem that has plagued to industry is the selection of an appropriate engine parameter about which to close the loop.

K. W. Randall and J. D. Powell from Stanford University in their research under a Department of Transportation sponsored project determined that for maximum efficiency of an internal combustion engine, the spark timing should be adjusted to provide a maximum cylinder pressure at a crankshaft angle 15 degrees past the piston's top dead center position. The results of this investigation are published in a Final Report NO SU-DAAR-503 entitled "Closed Loop Control of Internal Combustion Engine Efficiency and Exhaust Emission." The report contains a block diagram of a closed loop system in which a sensor detects the angle at which peak pressure occurs then compares this measured angle with the desired 15° angle. An error signal, generated when the measured angle differs from the desired angle, is used to correct the ignition timing signal generated in response to the other sensed engine parameters.

Comparable closed loop ignition control systems closed about the cylinder pressure are disclosed by M. M. Peterson in U.S. Pat. No. 3,957,023 entitled "Pressure Responsive Engine Ignition System" issued May 19, 1976 and Sand in U.S. Pat. No. 3,977,373 "Closed Loop Combustion Pressure Control" issued Aug. 31, 1976.

An alternate closed loop ignition control system taught by Pratt, Jr. et al in U.S. Pat. No. 3,897,766 entitled "Apparatus Adapted to Opto-Electrically Monitor the Output of a Prime Mover to Provide Signals which are Fed Back to the Input and Thereby Provide Control of the Prime Mover" issued Aug. 5, 1975 embodies a torque sensor which measures the twist in the output shaft of the prime mover to measure the torque. The measured torque and engine speed are used to close the loop about the engine.

Harned et al in U.S. Pat. No. 4,002,155 entitled "Engine and Engine Spark Timing Control with Knock Limiting, ect." issued Jan. 11, 1977 teaches a closed loop ignition system in which engine knock-induced vibrations are detected by an engine mounted accelerometer. The system counts the number of individual ringing vibrations that occur in a predetermined angular rotation of the crankshaft. When the number of ringing vibrations exceed a predetermined number, the engine spark timing is retarded and when the number of ring vibrations is less than a second pedetermined number, the spark timing is advanced.

Wahl in U.S. Pat. No. 4,015,566 entitled "Electronic Ignition Control System for Internal Combustion Engines" issued Apr. 5, 1977 teaches a closed loop ignition timing system closed about an operational parameter of the engine. In his patent, Wahl teaches sensing the temperature of a catalytic converter, the exhaust gas composition (especially NO compounds), or in the alternative using a vibration sensor to detect a rough running engine. The use of engine roughness as the measured parameter is similar to the system taught by Harned in U.S. Pat. No. 4,002,155 discussed above. In still another type of close loop system, Schweitzer et al in U.S. Pat. No. 4,026,251 entitled "Adaptive Control System for Power Producing Machines" issued May 31, 1977 teaches dithering the ignition timing and closing the loop about the engine's speed.

The closed loop ignition timing systems in which the cylinder pressure is measured directly as taught by Randall and Powell and implemented in the patents to Peterson and Sand appear as the most direct and effective engine parameter about which to close thee loop. However, this method requires a pressure transducer to be incorporated into at least one of the engine's cylinders where it is exposed to high temperatures and high pressures. Such pressure sensors are costly, have relatively short life expectancies and require additional modification to the engine for their use. Alternatively, pressure sensors adapted to be used in conjunction with the spark plugs are known but still suffer from the first listed deficiencies. The direct measurement of engine torque as taught by Pratt, Jr. et al is an alternate approach but requires a relatively complex and expensive torque measuring sensor. The measurement of the onset of engine knock or roughness as taught by Harned et al and Wahl respectively are believed to be too inaccurate to meet today's standards while the system taught by Schweitzer is believed to be ineffective because factors other than ignition timing such as a change in load could affect the engine speed and result in improper ignition timing.

Various types of closed loop fuel control systems for internal combustion engines have been developed in which the loop is closed about different engine parameters. The one of the parameters about which the loop is closed is the composition of the exhaust gas as taught by Seitz in U.S. Pat. No. 3,815,561 "Closed Loop Engine Control System" issued June 11, 1974 as well as many others. The system taught by Seitz uses an oxygen ($O_2$) sensor detecting the concentration of oxygen in the exhaust gas and closes the loop about a stoichiometric mixture of air and fuel. However, a stoichiometric mixture of air and fuel has been found to be too rich for the efficient operation of the engine. Various techniques have been employed to operate the engine at leaner air fuel ratios but the ability to achieve reliable closed loop control at the desired leaner mixture is limited by the characteristics of the present day oxygen sensors.

An alternate approach is taught by Taplin et al in U.S. Pat. No. 3,789,816 "Lean Limit Internal Combustion Engine Roughness Control System" issued Feb. 5, 1974 in which engine roughness is detected as the parameter about which the loop is closed. In this system, the airfuel mixture is leaned out until a predetermined level of engine roughness is achieved. The magnitude of engine roughness is selected to correspond with a level of engine roughness at which the air fuel mixture is made as lean as possible to the point that the formation of such exhaust gas as HC and CO is minimized without the drivability of the particular vehicle being unacceptable. Engine roughness as measured in the Taplin et al patent is the incremental change in the rotational velocity of the engine's output as a result of the individual torque impulses received from each of the engine's cylinders. The closing of the fuel control loop about engine roughness appears to be the most effective means for maximizing the fuel efficiency of the engine.

Leshner et al in U.S. Pat. No. 4,015,572 teaches a similar type of fuel control system in which the loop is cloed about engine power. In their preferred embodiment, Leshner et al use exhaust back pressure as a manifestation of engine power, however, state that a measured torque, cylinder pressure, or a time integral of overall combustion pressure for one or more engine revolutions at a given RPM may be used in the alternative. In a more recent advertising brochure "Breaking the Lean Limit Barrier", Fuel Injection Development Corporation of Bellmawr, New Jersey, the assignee of the Leshner et al patent, states that the parameter measured is the velocity of the engine's flywheel.

In another type of fuel control system using engine roughness as the sensed parameter to close the loop, Bianchi et al in U.S. Pat. No. 4,044,236 teaches measuring the rotational periods of the crankshaft between two sequential revolutions of the engine. The differential is digitally measured in an up down counter counting at a frequency proportional to the engine speed.

In an alternate type of roughness closed loop fuel control system, Frobenius et al in U.S. Pat. No. 4,044,234 "Process and Apparatus for Controlling Engine Operation Near the Lean-Running Limit" issued August, 1977, teaches measuring the rotational periods of two equal angular intervals, one before and one after the top dead center position of each piston. The change in the difference between the two rotational periods for the same cylinder is compared against a particular reference value and an error signal is generated when the change exceeds the reference value. Frobenius in U.S. Pat. No. 4,044,235 "Method and Apparatus For Determining Smooth Running Operation in an Internal Combustion Engine" issued August, 1977 teaches an alternate roughness control system wherein the periods of three sequential revolutions are compared to determine engine smoothness. The above reflects various ways in which engine roughness as detected by various means including the variations in the rotational velocity of the flywheel is used to close the loop about the engine.

The prior art teaches independent closed loop control systems, in which each control, i.e., ignition timing, fuel control, and fuel distribution are treated as separate entities. The Applicants herein teach an integrated engine control system in which the control loops for each controlled parameter is closed about a single measured engine operating parameter and in particular, the instantaneous rotational velocity of the engine's crankshaft. The data obtained from the singularly measured parameter is processed in different ways to generate timing and fuel delivery correction signals optimizing the conversion of combustion energy to rotational torque by the engine.

SUMMARY

The invention is a closed loop engine roughness control for controlling the fuel delivery to an internal combustion engine to maintain the operation of the engine at a predetermined roughness level. The control comprises a roughness sensor detecting the instantaneous rotational velocity of the engine's crankshaft to generate an engine roughness signal. The engine roughness signal is multiplied by an engine speed signal to generate a speed corrected roughness signal. The speed corrected roughness signal is summed with a reference signal to generate a bias signal operative to modify the fuel delivery signals generated by a fuel control computer. The signals generated by the fuel control computer modified by the bias signal control the fuel delivery to the engine maintaining the operation of engine at a predetermined roughness level. The closed loop control further includes a transient mode correction and a start correction. The transient mode correction generates a transient mode correction signal, indicative of the first derivative of the engine speed signal which is summed with the reference and the speed corrected roughness signals to compensate for false increases or decreases in the roughness signals generated during acceleration and deceleration. The start correction is generated during the starting mode of the engine in response to an engine speed below a predetermined speed. The start correction causes the closed loop control to output a fixed bias signal indicative of an engine roughness level greater than the predetermined level. The fuel control computer responding to the fixed bias signal outputs signal increasing the fuel delivery to the engine.

The object of the invention is a closed loop engine roughness control closed about the instantaneous rotational velocity of the engine's crankshaft. Another object of the invention is a closed loop engine roughness control having an output signal corrected for engine speed. Still a further object of the invention is a closed loop engine roughness control having an output signal corrected for transient modes of operation. A final object of the invention is a closed loop engine roughness control which outputs a fixed signal when the engine speed is below a predetermined value causing the fuel control computer to provide an enriched air/fuel mixture to the engine during a start attempt and for a short time thereafter.

BRIEF DESCRIPTIONS OF THE DRAWINGS

Figure 30:
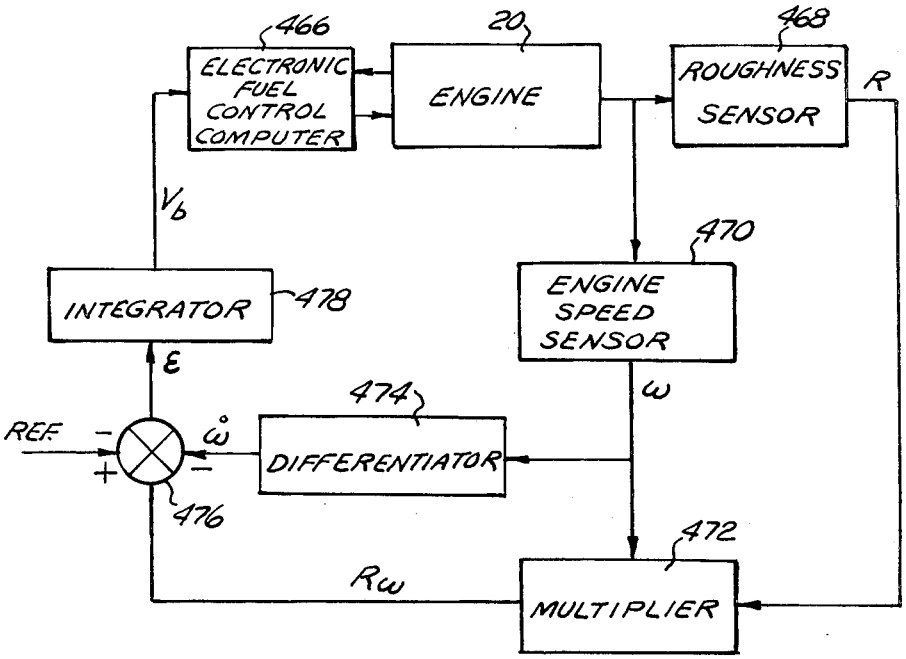
FIG. 30 is a block diagram of the Closed Loop Engine Roughness Control.
Figure 31:
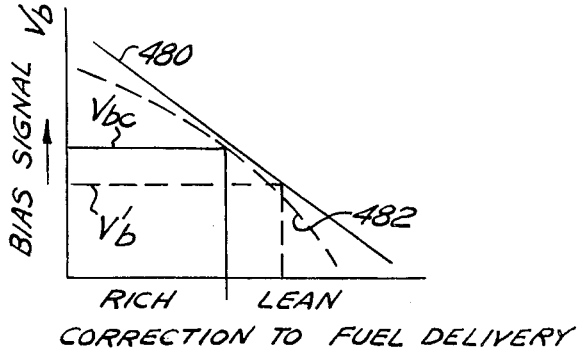
FIG. 31 is the graph showing the effect of the bias signal on the fuel delivery.
Figure 33:
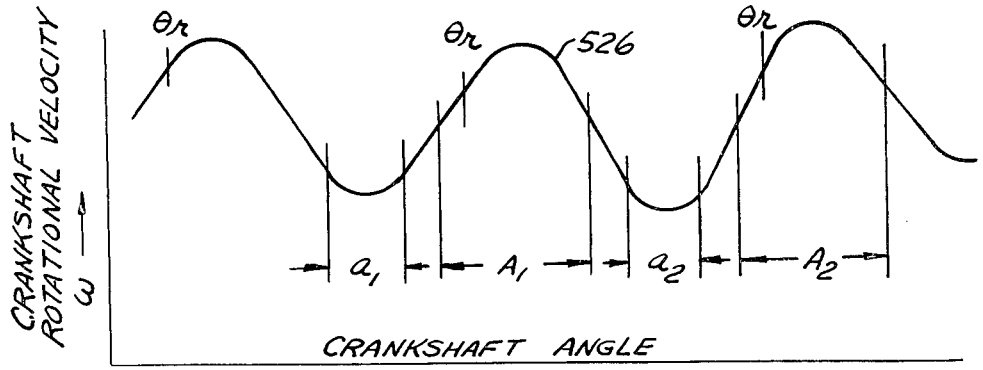
FIG. 33 is a waveform used in the description of the Roughness Sensor.
Figure 32:
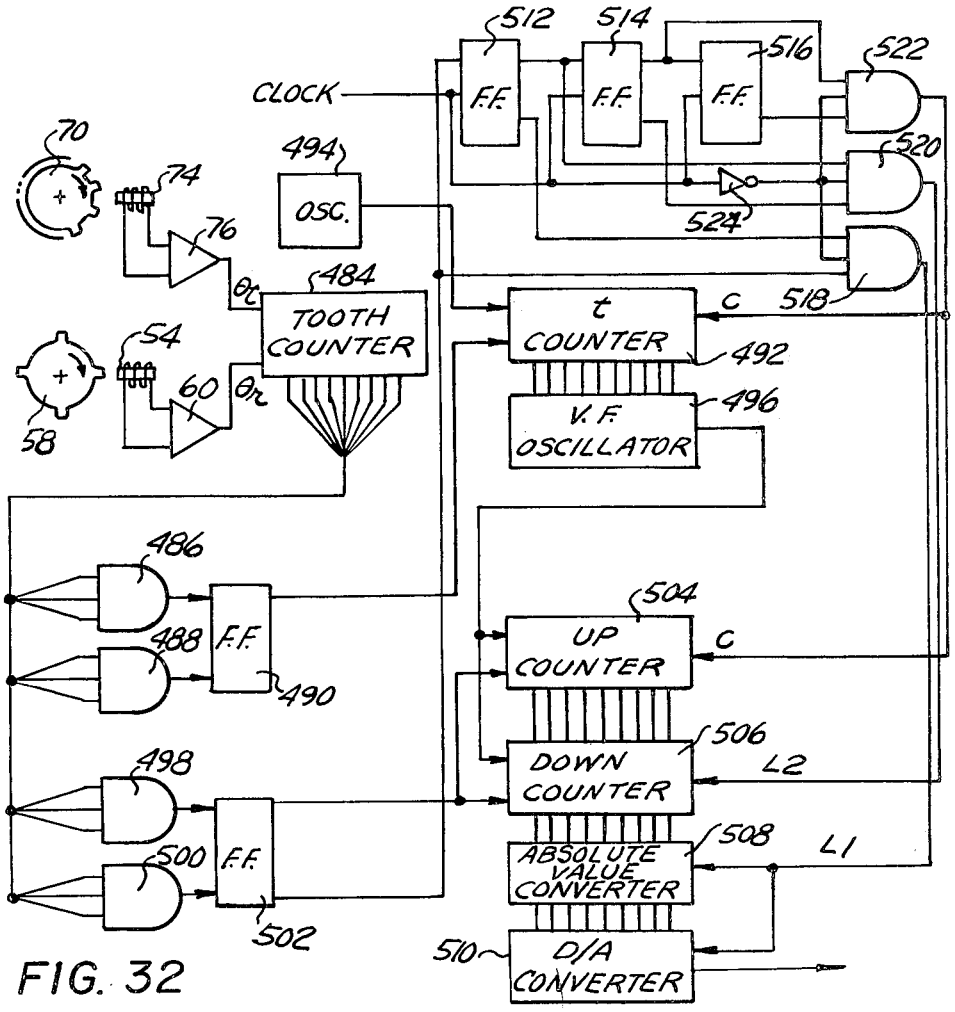
FIG. 32 is a circuit diagram of the Roughness Sensor.

For a better understanding of the drawing figures in this application, reference is made to the same figure numbers of the above referenced patent, U.S. Pat. No. 4,197,767.

These and other objects of the invention will become apparent from the reading of the specification in conjunction with the drawings.

What is claimed is:

1. A closed loop engine roughness control for an internal combustion engine having at least one combustion chamber, means for delivering a quantity of fuel to the engine in response to a fuel delivery signal, and a member receiving a torque impulse each time the fuel is burned in said at least one combustion chamber, comprising:

position reference signal generating means for generating a position reference signal indicative of incremental positions within an engine revolution correlated with an engine event;

first sensor means for generating first signals indicative of the instantaneous rotational velocity of the member relative to said position reference signal;

means for generating roughness signals in response to said first signals, said roughness signals having a value indicative of the difference in magnitude between two generated torque impulses;

second sensor means for generating second signals indicative of the average rotational speed of the engine;

means for multiplying said second signals with said roughness signals to generate a speed corrected roughness signal;

second reference signal generating means;

means for summing said speed corrected roughness signal with said second reference signal to generate a roughness correction signal;

means for integrating said roughness correction signal to generate a roughness bias signal;

third sensor means for generating a third signal indicative of at least one other operational parameter of the engine; and fuel control means for generating said fuel delivery signals in response to said third signal and said roughness bias signal, said fuel delivery signal modified by said roughness bias signal activating said fuel delivery means to deliver a quantity of fuel to the engine maintaining said roughness signal at a predetermined value.

2. The closed loop engine roughness control of claim 1 wherein said engine has a plurality of combustion chambers activated to burn the fuel in a predetermined sequence imparting sequential torque impulses to the member, said means for generating roughness signals generates said roughness signals indicative of the difference in magnitude between at least two torque impulses imparted to the member by the burning of fuel in each of said plurality of combustion chambers.

3. The closed loop engine roughness control of claim 2 further including:

means for differentiating said second signal to generate a fourth signal having a value inversely proportional to the change in said roughness signal due to an operator induced changes in engine speed; and wherein said means for summing further sums said fourth signal with said reference signal and said speed corrected signal to generate a roughness correction signal compensated for the operator induced changes.

4. The closed loop engine roughness control of claim 3 further including means responsive to said second signal having a value indicative of an engine speed below a predetermined speed for generating a start correction signal communicated to said means for summing, said start correction signal increasing the value of said roughness correction signal to a fixed value;

wherein said fuel control means generates fuel delivery signals increasing the quantity of fuel being delivered to the engine in response to the roughness correction signal having said fixed value during the starting of the engine.

5. The closed loop engine roughness control of claim 4 wherein said third sensor means includes a temperature sensor generating temperature signal indicative of the engine's temperature, said engine roughness control further includes means for generating warm-up signals inversely proportional to the difference between said temperature signal and a reference signal when said temperature signal has a value less than said reference signal; and wherein said means for summing further sums said warm-up signal with said speed corrected roughness signal and said fourth signal further increasing the value of said roughness correction signal and causing said fuel control means to generate fuel delivery signals increasing the quantity of fuel being delivered to the engine.

6. The closed loop engine roughness control of claim 4 further including means for limiting the maximum and minimum values of roughness correction signal to prevent the fuel delivery signals generated by the fuel control means to be changed by the roughness bias signal beyond the limits of engine operability.

7. A method for controlling the operation of an internal combustion engine having at least one combustion chamber, comprising the steps of:

generating a position reference signal indicative of incremental positions within an engine revolution correlated with an engine event;

detecting the rotation of the engine's output member to generate first signals indicative of the engine's instantaneous rotational velocity relative to said position reference signal;

processing said first signals to generate a roughness signal having a value indicative of the difference in the magnitude between two torque impulses received by the output member;

detecting the rotation of the engine's output member to generate a second signal indicative of the average rotational speed of the engine's output member;

multiplying said roughness signal by said second signal to generate a speed corrected roughness signal;

generating a second reference signal;

summing said speed corrected roughness signal with said second reference signal to generate a roughness correction signal;

intergrating said roughness correction signal to generate a roughness bias signal;

generating a third signal indicative of at least one other operational parameter of the engine; and then generating from said third signal and said roughness bias signal a fuel delivery signal indicative of the fuel required by the engine to operate at the predetermined roughness level wherein said fuel delivery means is activated by said fuel delivery signal to deliver the determined quantity of fuel to the engine.

8. The method of claim 7 wherein the engine has a plurality of combustion chambers activated to burn the delivered fuel in a predetermined sequence and impart to the output member sequential torque pulses one for each of said plurality of combustion chamber said step of processing said first signal generates roughness signals indicative of the difference in magnitude between two torque impulses generated by the plurality of combustion chambers.

9. The method of claim 8 further including the steps of differentiating said second signal to generate a fourth signal having a value inversely proportional to the change in the roughness signal due to operator induced changes in the engine speed; and wherein said step of summing further sums said fourth signal with said speed corrected roughness signal to generate a roughness correction signal compensated for operator induced changes.

10. The method of claim 9 further including the step of comparing said second signal to a reference signal indicative of a predetermined speed to generate a start correction signal having a predetermined value; and wherein said step of summing further includes summing said start correction signal with said reference signal, said fourth signal and said speed corrected signal to generate a roughness correction signal having a fixed value indicative of the engine operating at a roughness level greater than the predetermined roughness level.

11. The method of claim 10 wherein said step of generating a third signal further includes the step of generating a temperature signal indicative of the engine's temperature, said method further includes the step of comparing said temperature signal with a temperature reference signal to generate a warm-up correction signal having a value indicative of the difference between said temperature signal and said temperature reference signal when the value of said temperature signal is indicative of a temperature colder than the reference temperature signal; and wherein said step of summing further includes summing said warm-up signal with said reference signal, said fourth signal and said speed corrected roughness signal to generate said correction signal having a value modified by the value of said warm-up signal and indicative of the engine operating at a roughness level greater than the predetermined roughness level.

12. The method of claim 9 further including the step of limiting the value of said roughness correction signal to a range between fixed values to prevent the fuel delivery to the engine from exceeding the operating limits of the engine in response to the fuel control signal generated in response to the roughness bias signal.

13. A closed loop method for controlling the fuel delivery to an internal combustion engine using roughness sensing of a movable member of the engine, said method comprising the steps of:

generating a position reference signal indicative of incremental positions within an engine revolution correlated with an engine event;

generating first signals indicative of the instantaneous velocity of a movable member of the engine relative to said position reference signal;

generating roughness signals in response to said first signals, said roughness signals having a value indicative of the difference in magnitude between two torque impulses received by the movable member;

generating second signals indicative of the average speed of the engine;

multiplying said second signals with said roughness signals to generate a speed corrected roughness signal;

generating a second reference signal;

summing said speed corrected roughness signal with said second reference signal to generate a roughness correction signal;

integrating said roughness correction signal to generate a roughness bias signal;

third sensor means for generating a third signal indicative of at least one other operational parameter of the engine; and then generating fuel control signals from said third signal and said roughness bias signal modifying the quantity of fuel delivered to the engine for maintaining said roughness signals at a predetermined value.

* * * * *